US007739809B2

(12) United States Patent
Keating et al.

(10) Patent No.: US 7,739,809 B2
(45) Date of Patent: Jun. 22, 2010

(54) SHOE HAVING A REPLACEABLE PORTION AND REPLACEMENT METHOD

(75) Inventors: Brian Keating, West Hills, CA (US); Graham Jelley, Taichung (TW)

(73) Assignee: K-Swiss Inc., Westlake Village, CA (US)

( * ) Notice: Subject to any disclaimer, the term of this patent is extended or adjusted under 35 U.S.C. 154(b) by 851 days.

(21) Appl. No.: 11/518,992

(22) Filed: Sep. 12, 2006

(65) Prior Publication Data

US 2008/0060223 A1 Mar. 13, 2008

(51) Int. Cl.
*A43C 13/04* (2006.01)
*A43C 13/06* (2006.01)

(52) U.S. Cl. ..... 36/15; 36/71.5

(58) Field of Classification Search ..... 36/15, 36/71.5, 7.6, 134, 67 D, 77 R
See application file for complete search history.

(56) References Cited

U.S. PATENT DOCUMENTS 788,160 A 4/1905 Leadbeater et al.
4,073,075 A * 2/1978 O'Brien ..... 36/127
5,410,821 A 5/1995 Hilgendorf
5,768,809 A 6/1998 Sovoie
6,442,869 B2 9/2002 Coomes
6,598,324 B1 7/2003 Tsuji
2005/0278979 A1* 12/2005 Bramani ..... 36/59 R

* cited by examiner

*Primary Examiner*—Ted Kavanaugh
(74) *Attorney, Agent, or Firm*—Oblon, Spivak, McClelland, Maier & Neustadt, L.L.P.

(57) ABSTRACT

Exemplary embodiments of the invention provide a sole assembly having a first fixed portion and a second removable portion, wherein the removable portion is removably mounted to allow replacement, at least one projection extending from a peripheral edge area of the second portion and configured to be engaged with at least one portion of the sole assembly, at least one aperture formed in the second portion and at least one securing device which projects at least partially through the at least one aperture to secure the second portion to the sole assembly.

30 Claims, 4 Drawing Sheets

SHOE HAVING A REPLACEABLE PORTION AND REPLACEMENT METHOD

BACKGROUND

1. Field of the Invention

The present invention relates to a shoe having a portion that can be quickly and easily replaced.

2. Description of Related Art

The variety of activities and sports pursued has increased steadily in recent years. This increase has been sparked at least in part by advances in equipment technology which has allowed more people to enjoy a particular activity. Almost all sporting activities require the person to move themselves by walking or running. As such, the single most important piece of equipment is often the footwear worn by the user during the particular activity.

Athletic shoes, such as those designed for tennis, running, basketball, hiking, cross-training, walking and other activities, typically include a sole or sole assembly on a bottom portion of the shoe, which is fixedly secured by gluing or other similar attachment process to a soft and pliable upper portion of the shoe. The sole assembly usually includes a rubber outsole that contacts the ground surface and a cushioning midsole or midsole assembly above the outsole.

Athletic activities can be performed on various types of surfaces, such as asphalt, grass, dirt, and rocky surfaces, which are abrasive. Such surfaces can cause extensive wear or damage to the shoe. However, certain areas of the sole, for example in the toe, can wear or become damaged faster than other parts.

In the toe portion, excessive contact in this area with a ground surface can create a more worn-out or damaged area as compared to the rest of the sole. This uneven worn-out area can cause poor performance and/or discomfort to the wearer and possibly even injury. Thus, the uneven wear can affect at least the comfort, performance, appearance, and/or safety of the shoe.

Replacement of shoes having uneven wear is often an undesirable solution. Often, the other parts of the shoe have little or no wear, and thus, replacement of the entire shoe is wasteful. Further, sometimes the localized wear or damage occurs very rapidly, possibly during the first use or after only a small number of uses. Replacement of the entire shoe after such low usage is unsatisfactory to the user. Further, repair of the worn shoe is also not a desirable or satisfactory solution.

SUMMARY

As discussed previously, the wearing down of a portion of the sole of a shoe after repeated use is common with shoes for many types of activities. Providing the wearer of a shoe with the ability to replace worn out parts of the shoe and to maintain the structural integrity and performance of the shoe is a beneficial and less expensive way to avoid the above-discussed issues and problems.

Accordingly, it is an object of exemplary embodiments of the present invention to provide a shoe with a replaceable portion and methods for replacing a portion of the sole of a shoe.

According to various exemplary embodiments, the replaceable sole portion is preferably located in the toe portion of the shoe, however, other portions of the shoe could alternatively or additionally be replaceable.

By way of example, the invention can separately provide methods for easily interchanging and replacing the worn out toe or other portion with other removable portions when the currently used portion becomes worn out, damaged, or uneven.

According to an example of the invention, a user can choose from a plurality of replaceable toe portions, each of the toe portions having a different tread pattern. Thus, for example, a user could select a toe or other portion that is better for a particular surface and/or activity, even if wear is not presently an issue.

According to an example of an embodiment of the invention, one or more threaded studs are configured to pass through apertures in the replaceable toe portion to engage threaded bores in the bottom surface of the shoe to thereby secure the replaceable portion to the shoe main body. In addition, and also by way of example, projections extend from the replaceable toe portion to help align and secure the toe portion with the main body of the shoe when inserting the new toe portion.

By way of example, at least a part of the projections extending from the replaceable toe portion may extend at least partially through a receiving portion of the main body of the shoe.

The threaded studs can include, for example, an outer portion made of a same material as the replaceable toe portion.

Also by way of example, the invention can include a stud engaging device configured to couple with the studs and facilitate attachment and detachment of the studs from the replaceable toe portion or other portion of the shoe.

According to an example of the invention, the stud engaging device includes projection portions configured to engage receiving portions of the studs.

As should be apparent, the invention can provide a number of advantageous features and benefits. It is to be understood that, in practicing the invention, an embodiment can be constructed to include one or more features or benefits of embodiments disclosed herein, but not others. Accordingly, it is to be understood that the preferred embodiments discussed herein are provided as examples and are not to be construed as limiting, particularly since embodiments can be formed to practice the invention that do not include each of the features of the disclosed examples.

BRIEF DESCRIPTION OF THE DRAWINGS

The invention will be better understood from reading the description which follows and from examining the accompanying figures. These are provided solely as nonlimiting examples of the invention. In the drawings.

DETAILED DESCRIPTION OF THE PREFERRED EMBODIMENTS

Figure 1:
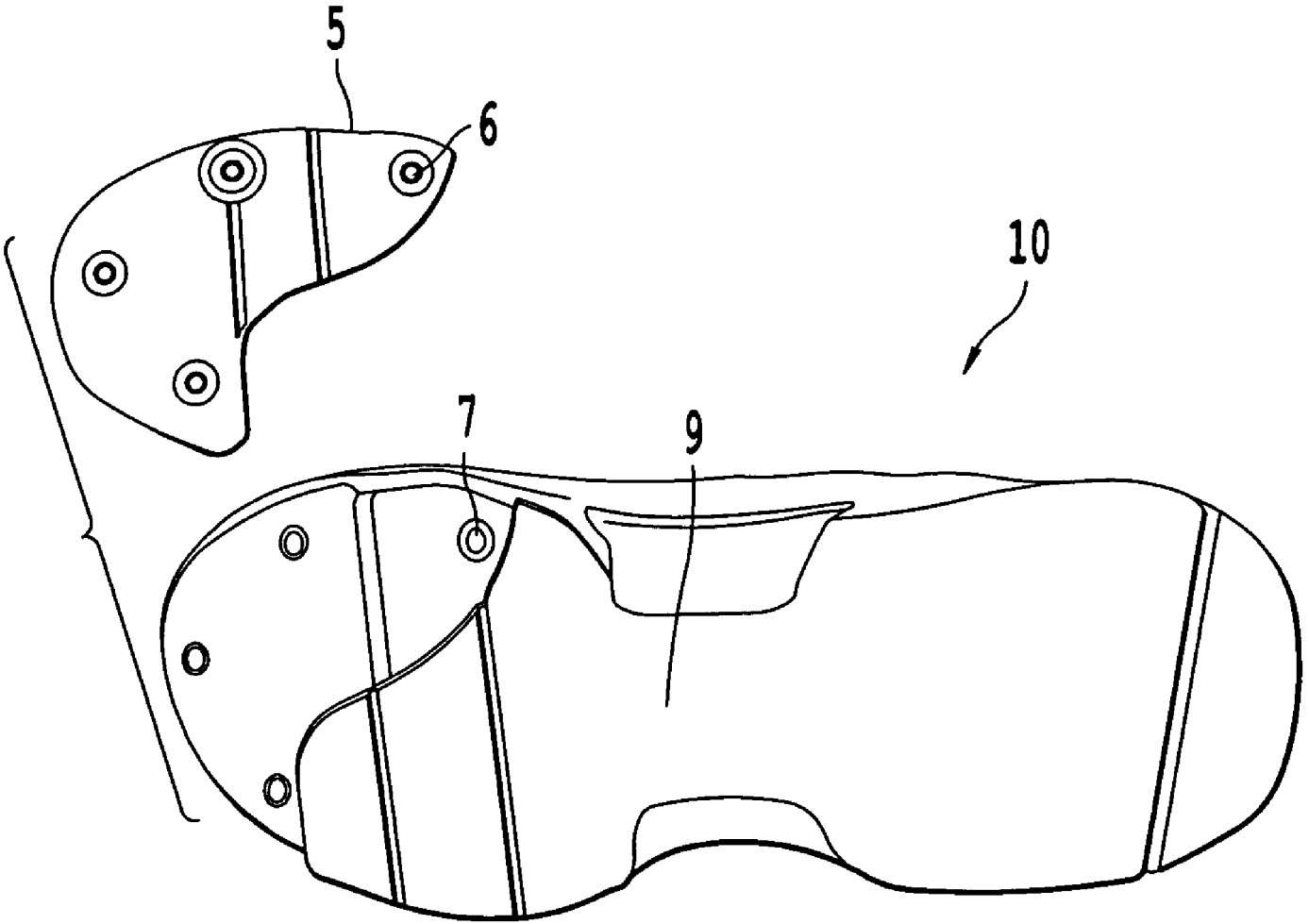
FIG. 1 is a schematic showing a plan view of the bottom portion of a shoe according to an example of the invention.

Reference will now be made in detail to the present preferred embodiments of the invention, examples of which are illustrated in the accompanying drawings. Wherever possible, the same reference characters will be used throughout the drawings to refer to the same or like parts.

FIG. 1 illustrates an example of an embodiment of a shoe of the present invention. The shoe, designated generally as 10 in the illustrated example, is an athletic shoe. Such shoes can be designed for tennis, running, walking, basketball, or other activities. Of course, it should be appreciated that the shoe of exemplary embodiments can be any type of shoe for any use desired by the wearer, which might require a toe or other portion of the shoe to be replaced. In the illustrated examples, the replaceable portion is provided in the toe region of the shoe, and the invention has been found to be particularly advantageous in addressing wear and/or damage that can occur in the toe region. However, aspects of the invention could also be used to provide replaceable portions in other parts of a shoe. In addition, although the toe or other portions are replaceable in response to wear in the preferred examples, the replaceable portion(s) could also be provided for other reasons. For example, different replaceable portions could be provided that have different tread and/or hardness characteristics so that a portion could be replaced that will provide the user with a different feel and/or performance characteristic.

As shown in FIGS. 1-4, shoe 10 includes an upper portion that covers the upper portion of the wearer's foot. By example, the upper portion 11 may be made of leather, a synthetic or natural fiber material or any combination of materials as is well-known in the art. A sole 9, as part of a sole assembly, is attached to a bottom of the upper portion by stitching, gluing or any other conventional means. The sole 9 is substantially oval or elliptical in shape with somewhat flattened medial and lateral sides. The shape of the sole 9 is not limited to the shape shown in the figures but could be circular, polygonal, or any other shape that will enhance the performance and/or aesthetics of the shoe for the wearer. The sole 9 is typically made of a lightweight material that provides cushioning during use. The shoe sole 9 has a traction area which extends from a heel end to a forward toe portion and extends across a width of the shoe 10.

According to one of the advantageous aspects of the illustrated example, the shoe 10 includes a removable toe portion 5 that may be easily interchangeable and replaceable with other removable toe portions, for example, when the currently used toe portion becomes worn out or damaged. Each toe portion 5 has a width that can extend across part of or an entire toe area of shoe 10. The toe portion 5 may have the same or different tread pattern as sole 9 to allow for flexibility and variance in the performance of the shoe 10.

According to an example of the invention, the toe portion 5 can extend, in addition to the forward toe area, along at least a portion of an inside peripheral edge of the shoe 10 and can separately or in addition to, extend along an outside peripheral edge part of shoe 10. A peripheral edge of the toe portion 5 is sized to generally mate with peripheral edges of the shoe 10. Similarly, a peripheral edge of the toe portion 5 that can form an edge with the sole 9, can be any shape so as to be substantially similar to the corresponding edge of the sole 9. That is, the peripheral edge of the toe portion 5 may contact the sole 9 and shoe 10 along an area substantially co-planar with the sole 9. According to an example of the invention, the replaceable toe portion 5 can be secured to the shoe 10 without contacting or forming an edge with sole 9 depending on design choices for the sole 9 and toe portion 5.

Figure 3:
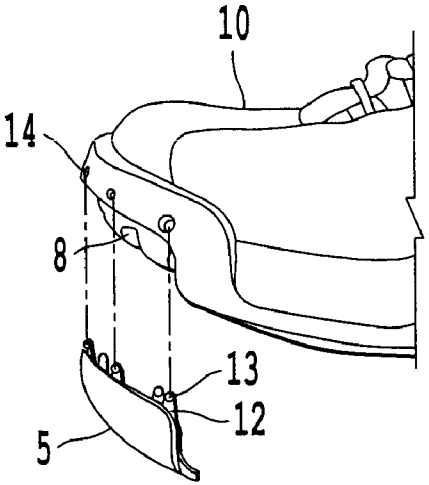
FIG. 3 is a schematic showing a perspective view of a system and method of attaching the toe portion to the main body of the shoe according to an example of the invention.
Figure 4:
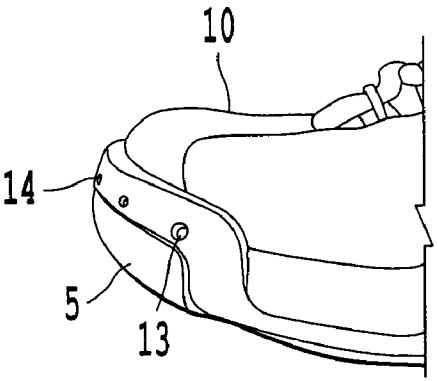
FIG. 4 is a schematic showing the shoe after the toe portion has been attached.

Additionally, according to one of the advantageous aspects of the illustrated example, a peripheral edge portion of the toe portion 5 may extend upwardly with respect to the plane of the sole 9 and contact an edge of the shoe 10, as best shown in FIGS. 3 and 4. For example, the toe portion 5 may extend out and around and cover any amount of the front or side part of the shoe 10. That is, it should be understood that the shape of the peripheral edges of the toe portion 5 and the corresponding peripheral edges of the sole 9 and shoe 10, can be any shape or size and be at any location in around, and at any part of the shoe, so as to provide a desirable mating edge. In this way, the performance, appearance, functionality of the shoe can be enhanced in addition to easing the interchangeability of the toe portion 5.

Figure 2:
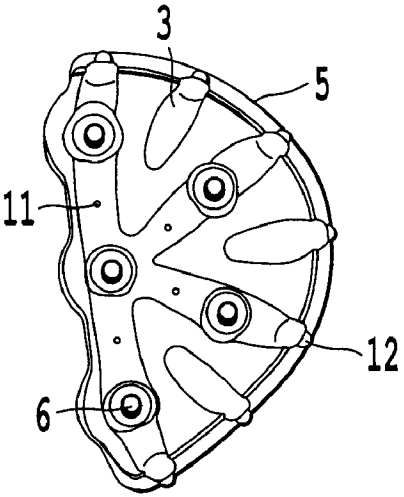
FIG. 2 is a schematic view showing an inside area of an example of a replaceable toe portion that will contact the shoe after attachment to the shoe.

As best shown in FIGS. 2-4, according to examples of the invention, the removable toe portion 5 can have one or more projections 12 formed on the peripheral edge of the toe portion 5. The projections 12 are attached to the toe portion 5, for example, by forming integrally therewith. According to examples of the invention, a base of at least one projection 12 can form a raised portion 3 from a main surface of the toe portion 5 to provide an uneven surface with the main surface. In addition to being formed at the base of projections 12, the raised portions 3 can be formed of varying heights anywhere along the surface of the toe portion 5 according to one or more exemplary embodiments.

Figure 5:
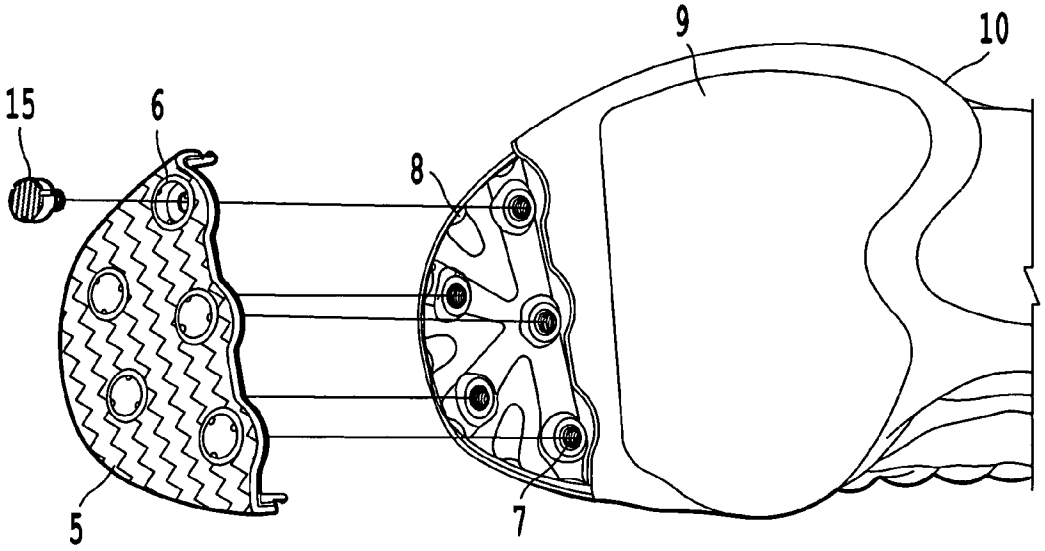
FIG. 5 is a schematic showing the toe portion being removably secured to a sole assembly of the shoe according to systems and methods of an example of the invention.

The raised portions 3 at the base of the projections 12 and/or other areas, can engage with guiding portions 8 formed in the sole assembly area. In this way, a contact area is formed between at least a part of the projections of the toe portion 5 and the guiding portions 8 of the sole assembly area of shoe 10. The guiding portions 8 can be in the form of grooves formed in the shoe 10 and can be formed at any location, for example, in between bores 7, in order to match the raised portions 3 of the toe portion 5, as best shown in FIG. 5. It should be appreciated that any structure can be provided for a guiding portion to allow for a proper alignment and an enhanced connection of the toe portion 5 with the rest of the shoe, without departing from the spirit and scope of the invention.

Additionally, the projections 12 can be formed to have an outwardly extending portion from the edge of the toe portion 5. Thus, when the toe portion 5 is connected with the shoe 10, the one or more projections 12, formed at any desirable length, are configured to be substantially aligned and engaged with guiding portions 8 formed in the sole assembly area of shoe 10. Further, according to examples of the invention, the one or more projections 12 may have a substantially transversely extending protruding portion 13 provided anywhere along the length of the projection 12, for example at a tip thereof. The protruding portion 13 can extend into a corresponding aperture 14 formed in the shoe 10 to further enhance the connection between the toe portion 5 and the shoe portion 10. The guiding portions 8 can extend for any desired length in order to receive the projections 12. For example, the guiding portions 8 can extend into and under the portion of the shoe containing the apertures 14 in order to be at least partially enclosed by the shoe 10.

The protruding portion 13 of the one or more projections 12 can extend in a direction away from the shoe portion 10 as shown in FIG. 3 or alternatively, can extend towards the shoe portion 10. The projections 12 and/or protruding portion 13 may be partially visible, for example through aperture 14, when attached to the shoe 10 or may be at least partially enclosed by the shoe 10.

According to one of the advantageous aspects of the illustrated example, it should be appreciated that the one or more projections 12 can extend away from any portion along the length of the peripheral edge of the toe portion 5 so as to engage various other parts of the shoe 10, for example the sole 9. Further, the projections 12 may or may not include the protruding portion 13 when engaging with the shoe 10. One or more inner projections 11 may be provided and located at an area of the toe portion 5 other than the periphery, such as in the middle portion, as best shown in FIG. 2. Similar to receiving the projections 12, one or more apertures 14 may be located at any location on the sole 9 or shoe 10 in order to receive the inner projections 11. Further, it should be appreciated that the shoe 10, according to one or more exemplary embodiment, can include projections and/or protrusions to engage with respective receiving portions of the toe portion 5.

Figure 6:
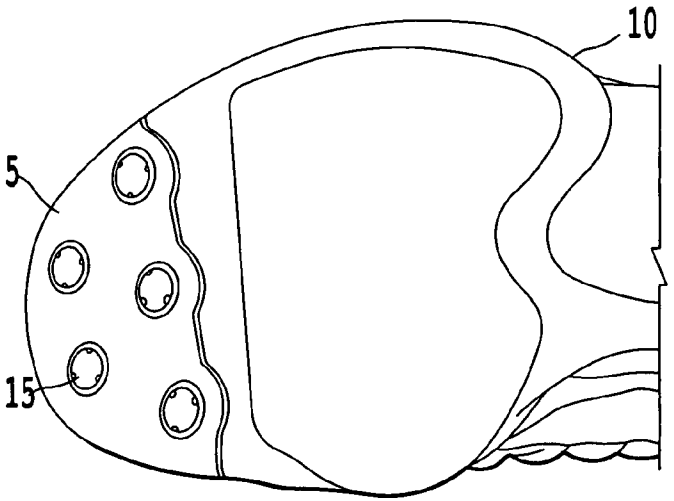
FIG. 6 is a schematic showing the shoe after the toe portion has been attached to the shoe according to an example of the invention.

FIGS. 5 and 6 are perspective views of shoe 10 with the replaceable toe portion 5 being connected according to systems and methods of advantageous aspects of the illustrated example of the invention. The sole assembly area of shoe portion 10 can include one or more bores 7 that communicate with one or more apertures 6 formed in the toe portion 5, when the toe portion 5 and shoe portion 10 are secured together. That is, the one or more bores 7 are positioned to be aligned with the one or more apertures 6 when the replaceable toe portion 5 is secured to the shoe portion 10. Accordingly, when one or more of the apertures 6 and bores 7 are aligned with each other, a corresponding number of one or more securing devices or studs 15 connect the toe portion 5 with the shoe.

Figure 9:
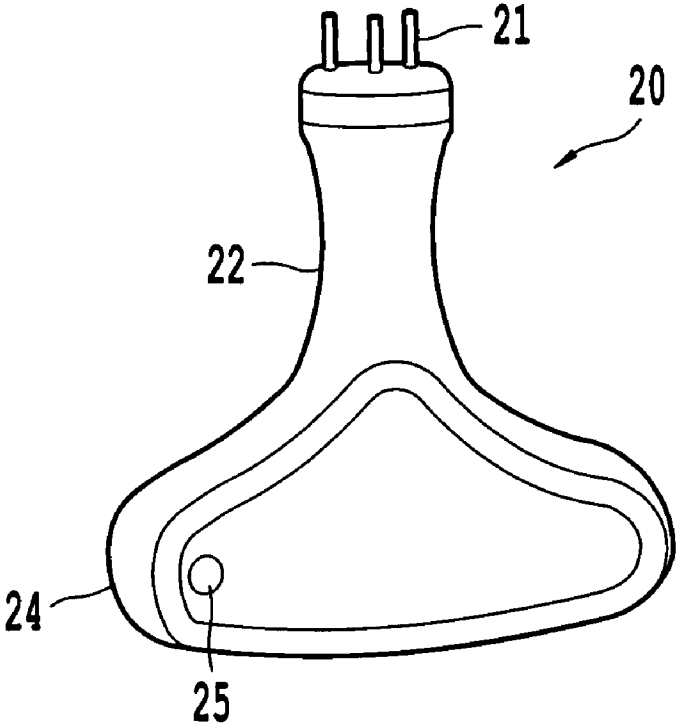
FIG. 9 is a schematic perspective view of a tool configured to engage the securing devices according to systems and methods of one or more exemplary embodiments of the invention.
Figure 7:
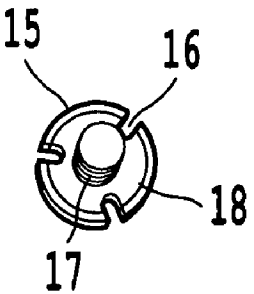
FIG. 7 is a schematic perspective view of a replaceable portion securing device according to one or more embodiments of the invention.
Figure 8:
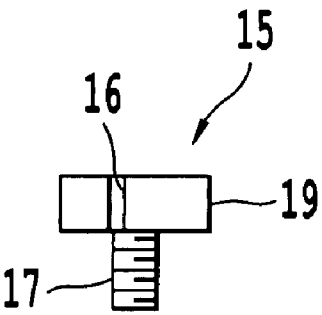
FIG. 8 is a schematic side view showing a securing device according to an example of the invention.

As best shown in FIGS. 7-9, each of the studs 15 includes a threaded portion 17 configured to pass through at least part of the aperture 6 in the interchangeable toe portion 5 and threadedly engage the threaded bores 7, thereby affixing the replaceable toe portion 5 to the shoe. It should be appreciated that any number of studs 15 may be used to secure the toe portion 5 to the shoe in order to provide a secure connection and not affect the performance of the shoe for the user. The threaded section 17 includes a flange portion 18 that extends radially from an axis of the threaded portion 17. A bottom surface or ground engaging surface 19 of the stud 15, is secured to the threaded portion 17 via the flange 18. The bottom portion 19 and threaded portion 17 can be secured together by an adhesive or any other conventional means in order to reduce or eliminate separation of the bottom portion 19 from the threaded portion 17.

The bottom surface 19 of the stud 15 that will contact the ground surface, may be made of the same material, such as rubber, as the remainder of the replaceable toe portion 5 and/or sole 9. However, it should be appreciated that the material used for the bottom surface 19 may be made of a material different from the remainder of the tread, if so desired. Similarly, a pattern or tread formed on the bottom surface 19 of the stud 15 can be different from the tread formed on the sole 9. It should be appreciated that the bottom surface 19, sole 9, and ground engaging surface of toe portion 5 can all be formed of the same or different material as the other depending on design, aesthetic, performance and/or other factors.

According to an example of an embodiment of the invention, the one or more of the apertures 6 may have a different size or shape than the remaining apertures 6. For example, the apertures 6 can have a flat bottom area for the flange 18 to rest on. Alternatively, the one or more apertures 6 may be tapered to allow a bottom surface 19 having the same configuration to fit therein. As such, the apertures 6 may have any desired size or shape depending on a corresponding size and shape of the stud 15 to be fitted therein. Having the capability to provide studs 15 and apertures 6 with different shapes and sizes if desired, allows the studs 15 to be placed at any location on the replaceable toe portion 5 in order to achieve a secure connection between the toe portion 5 and shoe and thus, enhance the performance of the shoe for the wearer.

As best shown in FIGS. 7 and 8, the stud 15 and more particularly, the bottom portion 19 and/or flange 18 of the stud 15, can include one or more receiving portions 16 spaced substantially equidistant from each other around a periphery of the stud 15. Of course, the any number of receiving portions 16 can be placed at any location on the periphery or at a position in a middle portion of the stud 15. The one or more receiving portions 16 are configured to be engaged by the stud engaging device 20 shown in FIG. 9.

The stud engaging device 20 according to systems and methods of an example of an exemplary embodiment of the invention, can include a body portion 22, one or more prongs 21 at one end, and a gripping portion 24 at another end. The stud engaging device 20 is configured to be gripped by the user around the gripping portion 24 with a single hand in order to facilitate the user rotating the studs 15 and thus, securing the toe portion to the shoe 10 via the threaded portion 17 of the studs 15 and bores 7 of the shoe 10. The stud engaging device 20 should be large enough to provide a comfortable grip for the user but also small enough to fit into the user's pocket or any sort of carrying case when not in use. The stud device 20 may also include an opening 25 in the gripping portion 24 to allow the user to carry it with a string, a chain, or the like. The stud device 20 may be made of any hard material, such as plastic, in order to maintain the structural integrity during use.

It should be appreciated that the one or more receiving portions 16 formed in the stud 15, may extend along an entire length of the bottom portion 19 and flange 18, or alternatively extend only a part of the length of the bottom portion 19. The length and shape of the receiving portions 16 may vary in accordance with the length and shape of the prongs 21 of the stud engaging device 20 in order to allow for an appropriate engagement between the prongs 21 and receiving portions 16. The one or more prongs 21 may be substantially parallel to each other or may be at any angle desired as long as the prongs 21 are able to project into and engage with the receiving portions 16. The one or more prongs 21 may be made of any hard material, such as stainless steel, to reduce the chance of bending or breaking.

Accordingly, the one or more studs 15 can be connected to a corresponding one of the one or more bores 7 in the shoe portion 10 via the threaded portion 17 of the stud 15, to fixedly attach the replaceable toe portion 5 to the shoe 10. In this way, a user is provided with the ability to replace a worn out toe or other portion of a shoe and thus, maintain the structural integrity and performance of the shoe. As such, a convenient and less expensive system and method of replacing a toe or other portion of a shoe is provided, to avoid the problems associated with wearing a shoe having a worn out portion.

Further, it should be appreciated that the exemplary embodiments of the invention are not limited to the exemplary replaceable toe portion shown and described above. While this invention has been described in conjunction with exemplary embodiments outlined above, various alternatives, modifications, variations and/or improvements, whether known or that are, or may be, presently unforeseen, may become apparent. Accordingly, the exemplary embodiments of the invention, as set forth above are intended to be illustrative, not limiting. The various changes may be made without departing from the spirit and scope of the invention. Therefore, the replaceable toe portion of a shoe and the systems and methods of replacing the toe portion according to exemplary embodiments of this invention are intended to embrace all now known or later-developed alternatives, modifications, variations and/or improvements.

The invention claimed is:

1. A shoe having a replaceable portion, comprising:

a sole assembly having a first fixed portion and a second removable portion, wherein said second removable portion is removably mounted to allow replacement;

at least one projection extending from a peripheral edge of the second portion and configured to be engaged with at least one portion of the sole assembly;

at least one aperture formed in the second portion; and at least one securing device which projects through the at least one aperture to secure the second portion to the sole assembly, wherein the second removable portion is continuously provided from a first lateral side of the sole assembly along a toe portion of the shoe and to a second lateral side of the sole assembly opposite the first lateral side.

2. The shoe according to claim 1, wherein the second portion includes a substantially planar portion and an upwardly extending side portion formed on at least a part of a peripheral area of the planar portion.

3. The shoe according to claim 2, wherein the shoe is a tennis shoe.

4. The shoe according to claim 2, wherein the side portion extends around at least part of a periphery of the shoe.

5. The shoe according to claim 2, wherein the at least one aperture is formed in the substantially planar portion.

6. The shoe according to claim 5, wherein the at least one projection includes a protruding portion that extends substantially transversely to a main body of the projection and engages with at least one aperture formed in the shoe.

7. The shoe according to claim 2, wherein the at least one projection extends from the upwardly extending side portion.

8. The shoe according to claim 1, wherein the first fixed portion and second removable portion form a tread layer of the shoe.

9. The shoe according to claim 8, wherein a majority of the tread layer is formed from the first fixed portion.

10. The shoe according to claim 1, further comprising threaded bores formed in a portion of the shoe, wherein each of the at least one securing device includes a tread area end and a threaded end, the threaded end configured to engage the threaded bores of the shoe.

11. The shoe according to claim 10, wherein the tread area end is made of a similar material as at least one of the first fixed portion and second removable portion.

12. The shoe according to claim 10, further comprising:

a coupling tool including at least one prong formed at one end of the coupling tool, configured to engage an at least one prong receiving portion formed in each securing device, to rotate the securing device and couple the threaded end of the securing device to the threaded bores of the shoe.

13. The shoe according to claim 12, wherein the at least one prong receiving portion extends along a length of the tread area end and a flange portion of the securing device.

14. The shoe according to claim 12, wherein the at least one prong receiving portion is located at a peripheral edge of the tread area end.

15. The shoe according to claim 1, wherein the second removable portion is a toe portion.

16. The shoe according to claim 1, wherein the second portion is sized to extend from the first fixed portion to a toe end of the shoe.

17. A method of replacing a portion of a shoe, comprising:

fixedly securing a first fixed portion to a sole assembly of the shoe;

aligning at least one projection formed on a removable second portion of the sole assembly with a projection receiving portion, wherein the at least one projection extends from a peripheral edge of the removable second portion;

engaging the at least one projection with the receiving portion;

inserting at least a part of at least one securing device through a respective at least one aperture formed in the second portion, to secure the second portion to the sole assembly, wherein the second removable portion is continuously provided from a first lateral side of the sole assembly along a toe portion of the shoe and to a second lateral side of the sole assembly opposite the first lateral side.

18. The method according to claim 17, wherein the second portion includes a substantially planar portion and an upwardly extending side portion formed on at least a part of a peripheral area of the planar portion.

19. The method according to claim 18, wherein the side portion extends around at least part of a periphery of the shoe.

20. The method according to claim 18, wherein the at least one aperture is formed in the substantially planar portion.

21. The method according to claim 18, wherein the at least one projection extends out from the upwardly extending side portion.

22. The method according to claim 17, wherein the first fixed portion and second removable portion form a tread layer of the shoe.

23. The method according to claim 22, wherein a majority of the tread layer is formed from the first fixed layer.

24. The method according to claim 17, wherein each of the at least one securing device includes a tread area end and a threaded end, the threaded end configured to engage threaded bores of the shoe.

25. The method according to claim 24, further comprising:

rotating the securing device with a coupling tool, wherein the coupling tool includes at least one prong formed at one end configured to engage at least one prong receiving portion formed in each securing device, to couple the threaded end of the securing device to the threaded bores.

26. The method according to claim 17, wherein the at least one projection includes a protruding portion configured to extend substantially transversely to a main body of the projection and engage with an aperture formed in the shoe.

27. The method according to claim 25, wherein the at least one prong receiving portion is located at a peripheral edge of the tread area end and a flange portion of the securing device.

28. The method according to claim 17, wherein the second removable portion is a toe portion.

29. The method according to claim 28, wherein the shoe is a tennis shoe.

30. The method according to claim 18, wherein the at least one projection extends out from the substantially planar portion.

* * * * *